US011877613B2

(12) United States Patent
Cox

(10) Patent No.: US 11,877,613 B2
(45) Date of Patent: Jan. 23, 2024

(54) REDUCED SEAM PROTECTIVE SPORTS GLOVE

(71) Applicant: Michael Cox, Baltimore, MD (US)

(72) Inventor: Michael Cox, Baltimore, MD (US)

(73) Assignee: WM. T. Burnett IP, LLC, Baltimore, MD (US)

( * ) Notice: Subject to any disclaimer, the term of this patent is extended or adjusted under 35 U.S.C. 154(b) by 505 days.

(21) Appl. No.: 16/999,724

(22) Filed: Aug. 21, 2020

(65) Prior Publication Data

US 2021/0022420 A1 Jan. 28, 2021

Related U.S. Application Data

(63) Continuation of application No. 15/645,805, filed on Jul. 10, 2017.

(60) Provisional application No. 62/359,789, filed on Jul. 8, 2016.

(51) Int. Cl.

| | |
|---|---|
| ***A41D 19/015*** | (2006.01) |
| ***A63B 71/14*** | (2006.01) |
| ***A41D 19/02*** | (2006.01) |
| *A63B 102/24* | (2015.01) |
| *A63B 102/14* | (2015.01) |

(52) U.S. Cl.

CPC ..... *A41D 19/01547* (2013.01); *A41D 19/015* (2013.01); *A41D 19/02* (2013.01); *A63B 71/143* (2013.01); *A63B 2102/14* (2015.10); *A63B 2102/24* (2015.10)

(58) Field of Classification Search

CPC ..... A41D 19/01; A41D 19/02; A43B 71/141; A43B 71/143; A43B 2102/14; A43B 2102/22; A43B 2102/24

See application file for complete search history.

(56) References Cited

U.S. PATENT DOCUMENTS

| | | | | | |
|---|---|---|---|---|---|
| 217,814 | A | * | 7/1879 | Munthe | A41D 19/01 2/907 |
| 739,743 | A | * | 9/1903 | Thompson | A41D 19/02 2/169 |
| 956,156 | A | * | 4/1910 | Ornas | A41D 19/02 2/169 |
| 1,427,419 | A | * | 8/1922 | Ruddell | A41D 19/02 33/12 |
| 1,525,999 | A | * | 2/1925 | King | A41D 19/02 2/169 |
| RE16,609 | E | * | 5/1927 | Sturm | A41D 19/02 2/169 |
| 2,211,215 | A | * | 8/1940 | Orne | A41F 1/06 D2/621 |

(Continued)

*Primary Examiner* — Heather Mangine

(74) *Attorney, Agent, or Firm* — Royal W. Craig; Gordon Feinblatt LLC

(57) ABSTRACT

An embodiment of the present invention provides a protective sports glove having a novel combination of liner sections, breathable mesh sections, stretch joints, and shock absorbing cushions to provide maximum protection to the user's fingers, hands, wrists, and lower forearms while maintaining as much flexibility within the glove and tactile feel on both palmar and dorsal sides of the glove as possible. A novel 2-panel palmar section construction eliminates the presence of seams, stitching or excess material in a critical area on the palmar side of a wearer's hand to further improve tactile feel and grip.

10 Claims, 4 Drawing Sheets

(56) References Cited

U.S. PATENT DOCUMENTS 2,632,172 A * 3/1953 Hagstrom ..... A41D 19/02 D2/622
2,642,573 A * 6/1953 Huck ..... A41D 19/00 2/169
2,723,399 A * 11/1955 Waller ..... A41D 19/0003 2/165
3,822,417 A * 7/1974 Lars-Jos ..... A41D 19/01547 2/169
4,245,357 A * 1/1981 Connelly ..... A41D 19/00 2/163
4,507,803 A * 4/1985 Ryan ..... A41D 19/01582 2/907
4,534,066 A * 8/1985 Hansson ..... A41D 19/02 2/907
4,663,784 A * 5/1987 Ash ..... A41D 19/02 2/163
4,700,405 A * 10/1987 Sternberg ..... A63B 71/146 2/161.1
5,027,439 A * 7/1991 Spector ..... A63B 71/143 2/907
5,809,571 A * 9/1998 Spitzer ..... A63B 71/148 2/163
5,867,830 A * 2/1999 Chen ..... A63B 71/148 2/161.1
6,154,885 A * 12/2000 Kobayashi ..... A63B 71/146 2/161.3
6,154,886 A * 12/2000 Hottner ..... A41D 19/02 2/167
6,298,490 B1 * 10/2001 Prouty ..... A41D 19/02 2/169
6,427,247 B1 * 8/2002 Suk ..... A63B 71/146 2/161.1
6,654,964 B1 * 12/2003 Staihar ..... A41D 19/02 2/161.1
6,760,924 B2 * 7/2004 Hatch ..... A41D 19/01505 2/163
2008/0109934 A1 * 5/2008 Widdemer ..... A41D 19/01523 2/159
2009/0183295 A1 * 7/2009 Rhee ..... A63B 71/143 2/163
2011/0113521 A1 * 5/2011 Bradford ..... A41D 19/01582 2/163
2014/0143926 A1 * 5/2014 Brown ..... A63B 71/143 2/20
2016/0082342 A1 * 3/2016 Brown ..... A41D 19/01523 2/20
2017/0239553 A1 * 8/2017 Kowalsky ..... A41D 19/01558
2018/0007984 A1 * 1/2018 Cox ..... A63B 71/143
2020/0397075 A1 * 12/2020 Iacono ..... A41D 19/01558

* cited by examiner

REDUCED SEAM PROTECTIVE SPORTS GLOVE

CROSS-REFERENCE TO RELATED APPLICATIONS

The present application is a continuation of U.S. application Ser. No. 15/645,805 filed 10 Jul. 2017, which derives priority from U.S. Provisional Application Ser. No. 62/359,789, filed 8 Jul. 2016, which is a continuation-in-part of U.S. patent application Ser. No. 14/080,097, filed 14 Nov. 2013, which in turn derives priority from U.S. Provisional Application Ser. No. 61/730,256 filed 27 Nov. 2012.

BACKGROUND OF THE INVENTION

1. Field of the Invention

The present invention relates generally to lacrosse gloves and, more particularly, to a protective sports glove and padding for the same that provides improved flexibility, increased protection, and finer tactile feel.

2. Description of the Background

Protective sports gloves are commonly used and, indeed, required to be used in many organized sports such as lacrosse, hockey, and other contact sports. Such gloves protect the wearer from the impact of lacrosse sticks, hockey sticks, balls, pucks, skates, and other players.

Protective sports gloves include padding to protect the player's fingers, hands, wrists and lower forearms. Despite their protective function, such gloves must balance other design factors such as weight, feel and flexibility. For example, the handling of a lacrosse stick requires a player to hold and control a lacrosse stick handle in specific ways, with many different combinations of hand placement over the length of the handle. A lacrosse player constantly moves his hands along the handle in multiple positions during game play.

In executing game skills, players of games such as lacrosse and ice hockey must be able to grip and control the stick handle, e.g., "stick handling." Effective stick handling requires a lacrosse player to constantly reposition his hands along the handle to control the head of the lacrosse stick that features a web pocket essential for ball retention, passing and shooting. For effective stick/ball handling, a lacrosse player needs to maintain utmost flexibility of the hand, a sure grip, a precise tactile feel for the stick. However, the hand also needs protection from checking by an opponent's stick so players typically wear padded gloves to protect the back of their hands and wrists. These gloves usually include foam padding or other protective padding covering the back of a wearer's hand, fingers, and thumb. However, the thickness, placement, and other qualities of such padding and glove material in general should ideally cause the least amount of interference with the wearer's natural grip and hand movement during play. An additional requirement of such gloves is that they be comfortable enough to wear for several hours (an entire game and/or practice session) and that the ability of the glove to cause blisters or rash by rubbing against the wearer's hands and/or between the wearer's hands and his or her stick is minimized.

Some conventional sports gloves have pad segments (e.g., made of foam) that are covered with leather or synthetic leather and, in the breaks between the segments, are affixed to one another and to a liner material (also known as the scrim), such as a woven fabric. In these conventional gloves individual foam pads are typically sandwiched between two fabric layers and the layers are sewn together, and to the liner, between breaks in adjacent pads. However, this conventional construct is fairly rigid in design and compromises flexibility and tactile feel for protection. When such a protective athletic glove undergoes deformation due to normal use by a wearer, adjacent pads come into contact with each other and this arrests/resists further motion. When finding the right finger position, e.g., sliding fingers over the stick, prevalent pads and/or seams provide confusing tactile feedback. In addition, the inflexibility of the fabric layers and liner resist stretching and further arrests/resists motion. In straining against these forces to maintain a grip on the lacrosse stick, a player tends to lose their tactile feel for the stick, and consequently their stick handling capability.

Another common feature of conventional sports gloves is the way in which the palmar face of the glove is formed. Because the palmar side of the wearer's hand is usually wrapped around a stick during sports such as lacrosse or hockey, it is less likely to be impacted by other sticks, players, equipment, etc., and therefore the palmar side of gloves for such sports typically has no padding, or at most a thin layer of padding. Instead, the palmar side of the glove is often constructed from multiple panels of a leather or synthetic leather material sewn or otherwise joined together in a single-layer palmar section as shown in FIGS. 1A and 1B. Optionally, but not necessarily, the palmar side may also have an inner liner formed of the same scrim fabric used on the dorsal side.

FIG. 1B is an exploded view of the three separate palmar panels 11, 12, 13 typically used for construction of the conventional sports glove, while FIG. 1A illustrates the palmar side of a prior art protective sports glove 1 assembled from component panels 11, 12, 13 of FIG. 1B. As can be seen, finger panel 13 forms a shape sufficient to cover the palmar side of the fingers (index, middle, ring, and pinky) of the wearer, and at least a portion of the metacarpal area of the wearer's ring and pinky fingers. Thumb tower section 11 forms a shape sufficient to cover the palmar side of the wearer's thumb. Cross-palm section 12 overlays both sections 13 and 11 in the cross-hatched areas of those sections as shown in FIG. 1B, and as shown in FIG. 1A, as assembled, extends from a carpal area of the user's pinky, ring and middle fingers to an area adjacent a proximal phalange of the wearer's index finger, or an area overlapping the crease between the wearer's index finger and thumb.

The joinder of distinct panels making up a protective sports glove such as the one illustrated in FIGS. 1A and 1B require seams, which at a minimum will be as thick as two layers of palmar material (leather or synthetic), and possibly thicker depending on the method of attachment, and the presence of scrim and/or any other layers of padding affixed to the panels on the palmar side of the glove. The stitching, discontinuity and added thickness obfuscates the player's tactile feel. Moreover, the most common hand-hold positions for a player in lacrosse, ice hockey, or like sports involve contacting their stick with the middle of their palm or gripping it between their thumb and index finger. Applicant has discovered that the majority of tactile sensation is derived from a crescent-shaped area running beneath the proximal phalanges of the hand, circling below the index finger proximate the thumb joint and arching around to the center of the base of the palm. This "crescent" traverses most all the flex lines of the hand (below the heart line to the thumb joint between the phalanx and metacarpal junction). Seams, stitching and/or undue thickness in this crescent area of prior art glove 1 detracts from the wearer's feel for the stick, and impedes stick handling.

What is needed is a protective sports glove and particularly an improved palmar section for the same that employs a novel palmar section to avoid seams, stitching or overlayed layers along a crescent-shaped area running beneath the proximal phalanges of the hand, circling below the index finger proximate the thumb joint and arching inward toward the center of the base of the palm. This would provide improved flexibility, increased protection, and finer tactile feel.

SUMMARY OF THE INVENTION

In one aspect, a protective glove uses a hand receiving portion with a dorsal side and a palmar side. The palmar side of the hand receiving portion includes a palmar section comprising two distinct panels of material both formed of leather or synthetic leather including meshes. The palmar section material may optionally include an innermost fabric scrim or liner for comfort. The two distinct palmar panels are cut in complementary shapes and sewn together to form the palmar section. The inventive pattern ensures an unbroken, single-layer, seamless, stitchless crescent-shaped area that runs beneath all the proximal phalanges of the hand, circling below the index finger proximate the thumb joint and arching inward to the center of the base of the palm. The absence of seams, stitching and/or undue thickness in this crescent area optimizes the wearer's feel for the stick, and improves stick handling.

The palmar side may also include discrete peripheral areas of additional padding to protect the bones or fleshy portions of the wearer's hand.

The present invention is described in greater detail in the detailed description of the invention and its embodiments, and the appended drawings. Additional features and advantages of the invention will be set forth in the description that follows, will be apparent from the description, or may be learned by practicing the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

Described herein is a protective sports glove that provides an unbroken, single-layer, seamless, stitchless crescent-shaped palmar area that runs beneath all the proximal phalanges of the hand, circling below the index finger proximate the thumb joint and arching inward to the center of the base of the palm. For purposes of the instant description, the term "palmar crescent" is herein defined as that crescent-shaped portion of the user's hand running from beneath the little finger across all the proximal phalanges of the fingers (pinky, ring, middle and index) of the hand, circling below the index finger and around by the thumb joint, and arching inward to the center of the base of the palm. The absence of seams, stitching and/or undue thickness in this crescent area optimizes the wearer's feel for the stick, and improves stick handling.

Figure 3:
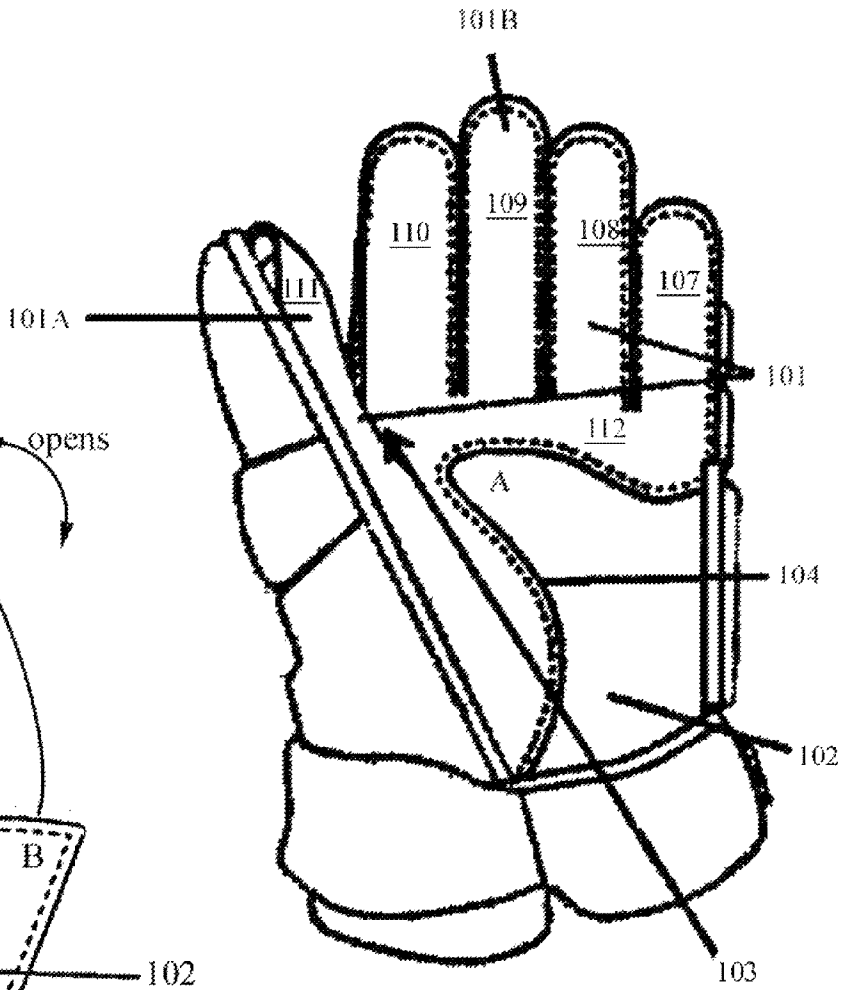
FIG. 3 is a perspective illustration of the palmar side of the protective sports glove according to an embodiment of the present invention.
Figure 2:
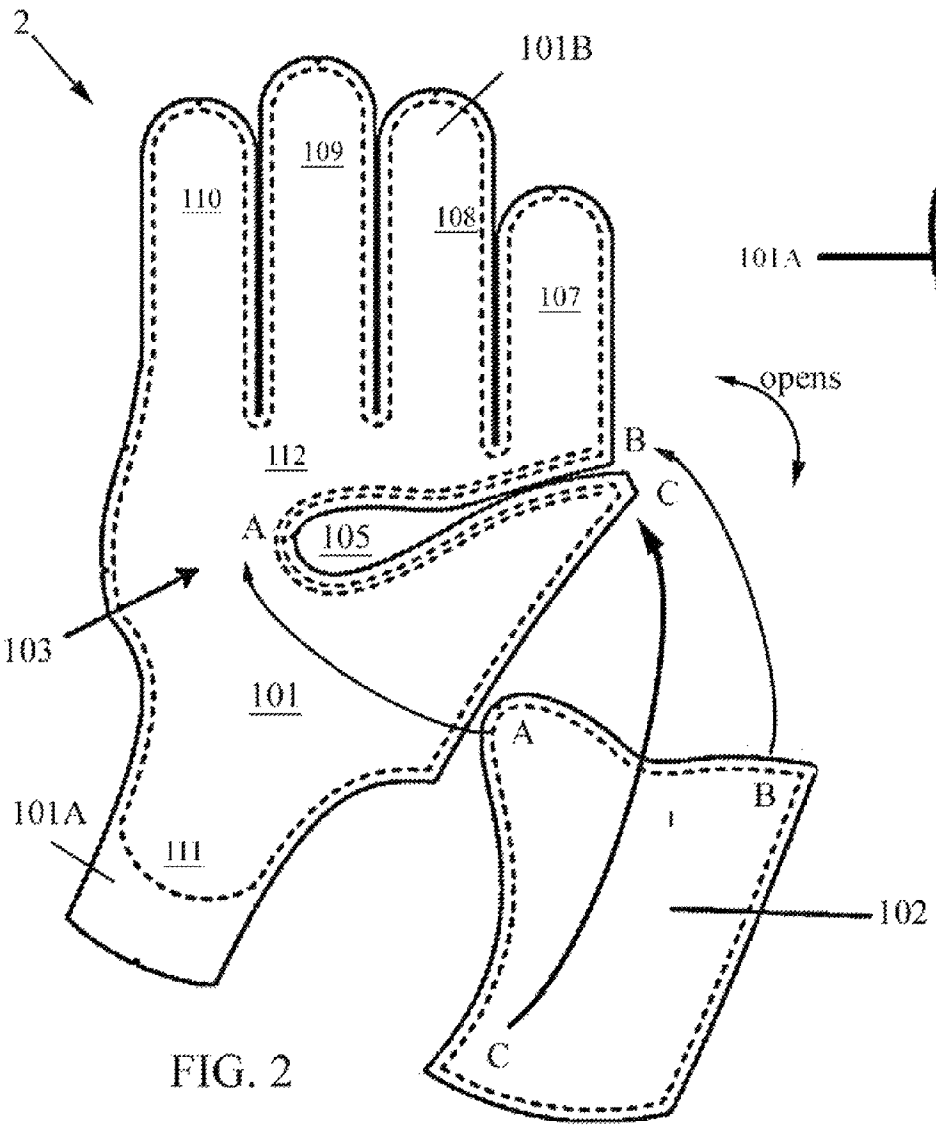
FIG. 2 is an exploded view of the fabric patterns making up the palmar side of the protective sports glove according to an embodiment of the present invention.

With reference to FIGS. 2 and 3, a first embodiment of the "seamless" palmar construction for the palmar section 2 of a protective sports glove according to the present embodiment is shown. The palmar section 2 of the glove is constructed essentially from two panels of particular shape: 1) a digit panel 101; and 2) a palm panel 102.

Digit panel 101 includes an upper portion 101B designed to simultaneously cover the palmar side of four of the wearer's digits, including pinky, ring, middle and index fingers. Digit panel 101 also includes a lower portion 101A designed to cover the base of the hand including, as will be described, a portion of the palmar side of the thumb. The entire digit panel 101 inclusive of the upper portion 101B bridged to lower portion 101A consists of a unitary unbroken seamless layer of leather or synthetic leather or mesh, preferably cut from a singular fabric blank. The upper portion 101B of digit panel 101 is separated from the lower portion 101A by a bulbous notch 105 with ingress beginning at the base of the little finger and projecting laterally across the digit panel 101 to approximately midway, leaving an unbroken bridge of material under the purlicue (the space between the thumb and index finger on the wearer's hand) and joining the upper and lower portions 101B, 101A.

Palm panel 102 likewise consists of a unitary unbroken seamless layer of leather or synthetic leather or mesh, preferably cut from a singular fabric blank in an irregular but generally four-sided shape. Palm panel 102 is designed to cover the base of the hand inclusive of the hypothenar muscles and common flexor sheath (ulnar bursa).

FIG. 3 shows the palmar section 2 of the glove assembled from the two panels 101 and 102 illustrated in FIG. 2. The two panels comprises a digit panel 101 and palm panel 102 and both may be cut from material blank(s) in the cut patterns shown in FIG. 2. The upper portion 101B of the digit panel 101 has a plurality of parallel-protruding finger sections 107, 108, 109, 110 protruding from a main section 112, and the lower portion 101A comprises a thumb section 111 protruding from the main section 112 away from the finger sections 107, 108, 109, 110 at an obtuse angle. The cut pattern includes a notch 105 cut across the main section 112 of the digit panel 101 entering between two notch points B, C along a periphery of the digit panel 101 and traversing below the finger sections 107, 108, 109, 110 to a third notch point A. The palm panel 102 is cut in a three-or-four-sided cut pattern having three contiguous corner points A, B and C as shown.

As indicated by the location of reference points A, B and C on the assembled palmar section shown in FIG. 3, during assembly of digit panel 101 and palm panel 102, the digit panel 101 is contorted by rotating the lower portion 101A including thumb section 111 clockwise about the notch terminus A toward the finger sections 101B to reduce the obtuse angle of the lower portion 101A and thumb section 111 to an acute angle, until reference point C is rotated from its unassembled position as shown in FIG. 2, clockwise down towards the user's wrist to cover an area roughly corresponding to the hypothenar group of muscles at the base of the user's thumb, and to open notch 105, thereby creating a fold in digit panel 101 in the area indicated by reference character 103, which corresponds to the purlicue (the space between the thumb and index finger) on the wearer's hand. The notched thumb section 111 of lower portion 101A rotates clockwise "upwards" towards the index finger-covering portion 110 of upper portion 101B as shown in FIG. 3, such that its outer edge can meet an outer edge of a dorsal portion of the glove upon final assembly (not shown). Rotation of lower portion 101A including thumb section 111 opens notch 105 to allow the three points of palm panel 102 (indicated by reference points A, B and C) to meet the corresponding A, B and C points on digit panel 101 for assembly.

To assemble the palmar section 2, digit panel 101 may (optionally) be sewn to an underlying liner or scrim along the seamlines shown in dotted lines in FIGS. 2 and 3. Palm panel 102 is then attached to the digit panel 101 along its seamlines (likewise shown dotted), with reference points A, B and C aligned and connecting as shown in FIG. 3. The joinder of palm panel 102 to digit panel 101 keeps digit panel 101 in the "open" position, i.e., with notch 105 opened and thumb tower T rotated "upwards" towards an outer edge of the index finger-covering portion of upper portion 101B, which then holds the thumb tower T up and creates a fold between the thumb and forefinger at area 103. The unique and specifically designed "teardrop" shape of notch 105 in digit panel 101 allows for the above-described fold and rotation movement of digit panel 101 for assembly of palmar section 2 by joinder of digit panel 101 and palm panel 102, and for the desired area of palm coverage (along the palmar crescent as herein defined) without interference by stitching or overlapping pads or sheets of material. The unique shape of notch 105 also allows for the use of palm panel 102 to hold thumb tower T of digit panel 101 in the desired position to join with an exterior edge of a dorsal portion of the fully assembled glove.

Thus, as described, the notch 105 of digit panel 101 overlies the palm panel 102 leaving the entire palmar crescent of the user's hand covered by a seamless unbroken single layer from beneath the little finger and all the proximal phalanges of the hand, circling below the index finger and around by the thumb joint, and arching inward to the center of the base of the palm. This optimizes the wearer's feel for the stick, and improves stick handling.

The only overlap of panels 101 and 102 occurs under and/or over (depending on order of layering during assembly, as may be varied) palm panel 102 outside of notch 105 along the base of the hand inclusive of the hypothenar muscles and common flexor sheath (ulnar bursa), where more padding and protection is advantageous. This particular pattern including shape and complementary attachment of digit panel 101 and palm panel 102 provides maximum tactile feel and the minimum amount of interference between the hand of a player and the stick, so that he or she can obtain the greatest tactile feel and muscle control over the stick, while still providing protection for the wearer's hands.

Figure 1A:
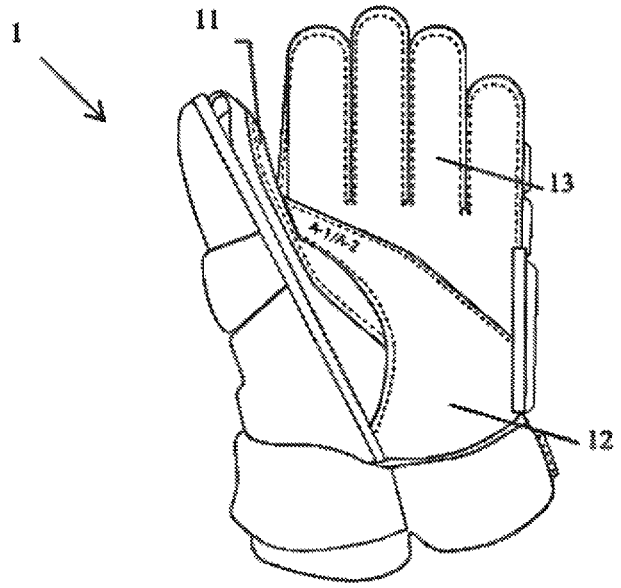
Fig. 1A(Prior Art)
FIG. 1A is a perspective illustration of the palmar side of a prior art protective sports glove.
Figure 1B:
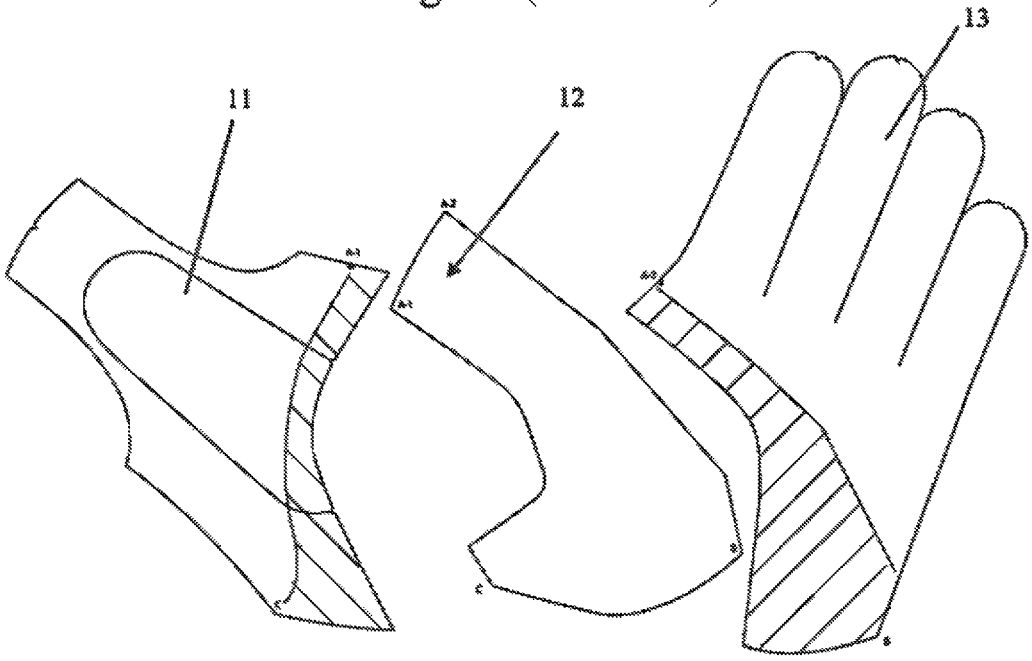
Fig. 1B(Prior Art)
FIG. 1B is an exploded view of the fabric patterns making up the palmar side of the prior art protective sports glove of FIG. 1A.

FIG. 3 further shows that the central portion of the palmar section 102 is covered by palm panel 102 and only a single continuous seam 104 runs along this surface. Unlike seams present on the palmar side of prior art sports gloves, however, seam 104 does not appear in a critical area of the wearer's hand (e.g., the palmar crescent) such that his or her ability to properly grip and control the stick could be compromised by excess material and/or thick or rough seams. Instead, the wearer of the present inventive glove comprising palmar section 2 is able to, with greater precision, feel the position of the stick with his or her thumb and index finger and flex the muscles at the base of his or her thumb and index finger to maneuver the stick within his or her purlicue. As can be seen by comparing FIG. 3 to FIG. 1B, the novel two-panel construction of the palmar section 2 as compared with that in the prior art also prevents redundant patterns and saves material in the construction of the actual glove.

Figure 5:
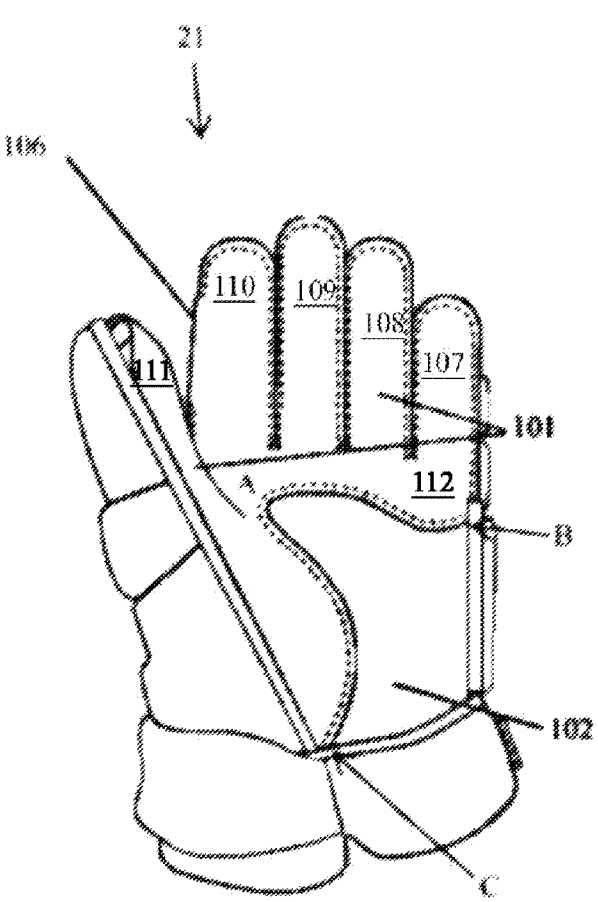
FIG. 5 is a perspective illustration of the palmar side of the protective sports glove according to the embodiment shown in FIG. 4.
Figure 4:
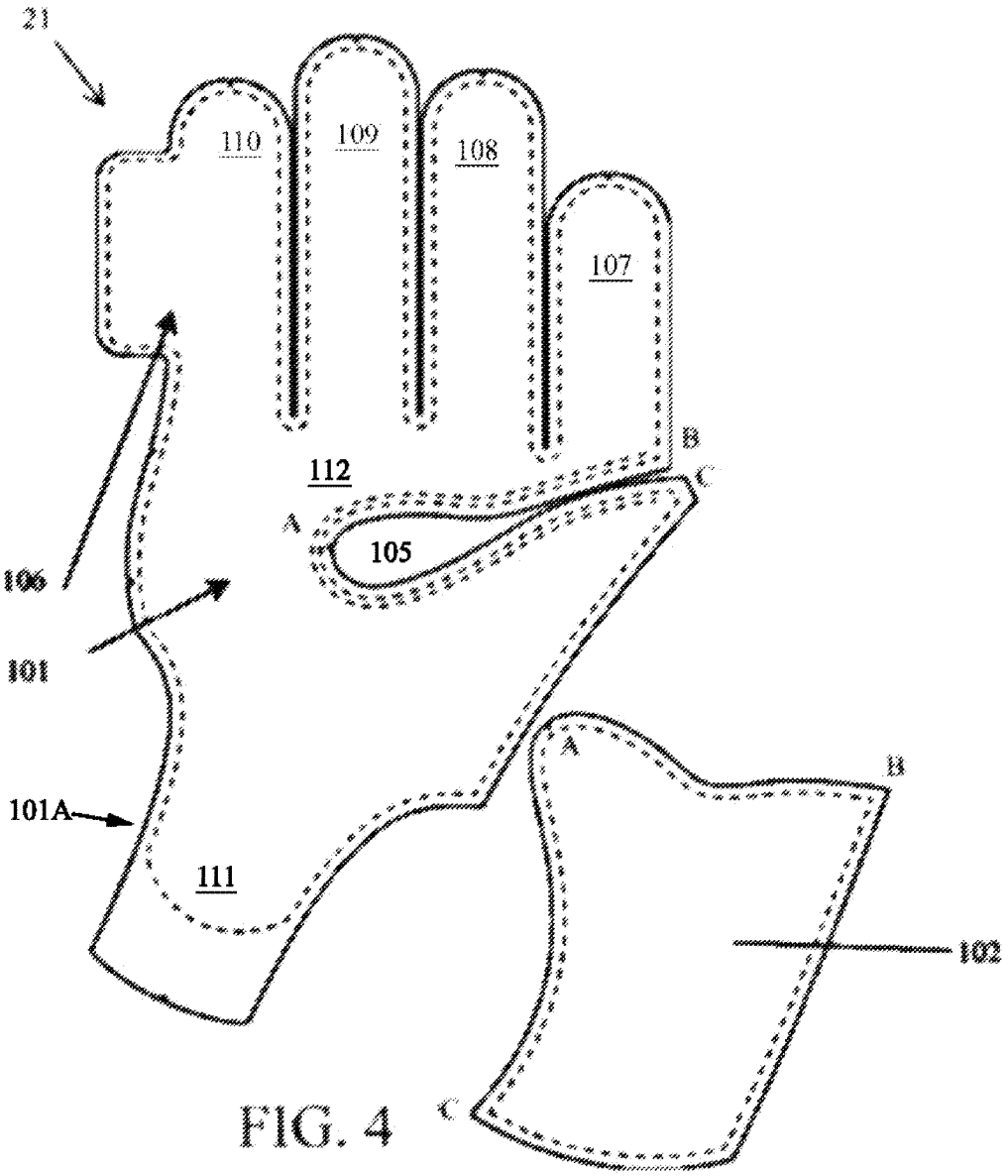
FIG. 4 is an exploded view of the fabric patterns making up the palmar side of the protective sports glove according to another embodiment of the present invention.

An additional embodiment of the inventive palmar construction herein described is illustrated with respect to FIGS. 4-5. FIGS. 4 and 5 show, respectively, the exploded view and the complete construction of a two-panel palmar section 21 of the glove further comprising a finger roll gusset 106 on digit panel 101 that provides an additional layer of padding and reinforcement at the inner edge of the wearer's hand along the second and third metacarpals of the index finger where the stick (lacrosse, hockey, etc.) is typically held. Finger roll gusset 106 protects against abrasion in this critical area of the palmar side of glove. Allowing at least a portion of the outer edge of the index finger-covering portion of digit panel 101 to wrap around the outer edge of the glove between the palmar side and the dorsal side also provides a smooth, seamless contact surface against the stick that the wearer can use to obtain better control of and grip on the stick.

Figure 7:
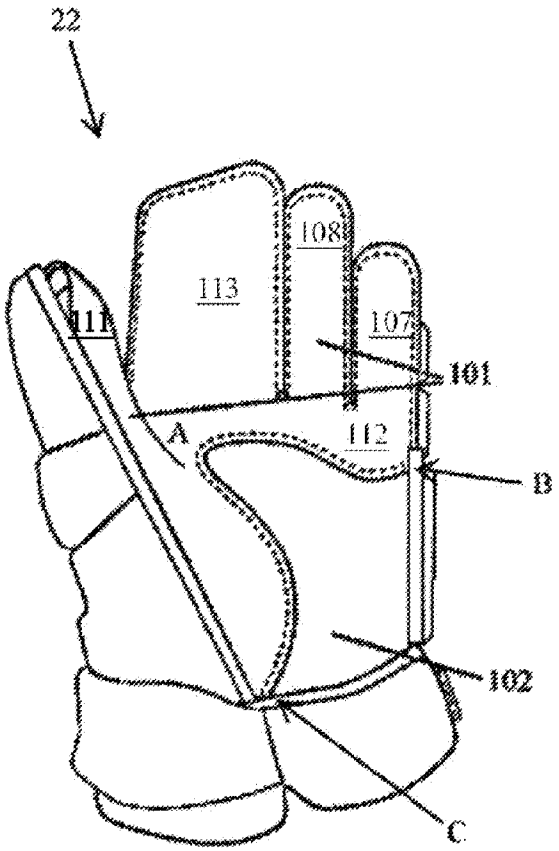
FIG. 7 is a perspective illustration of the palmar side of the protective sports glove according to the embodiment of FIG. 6.
Figure 6:
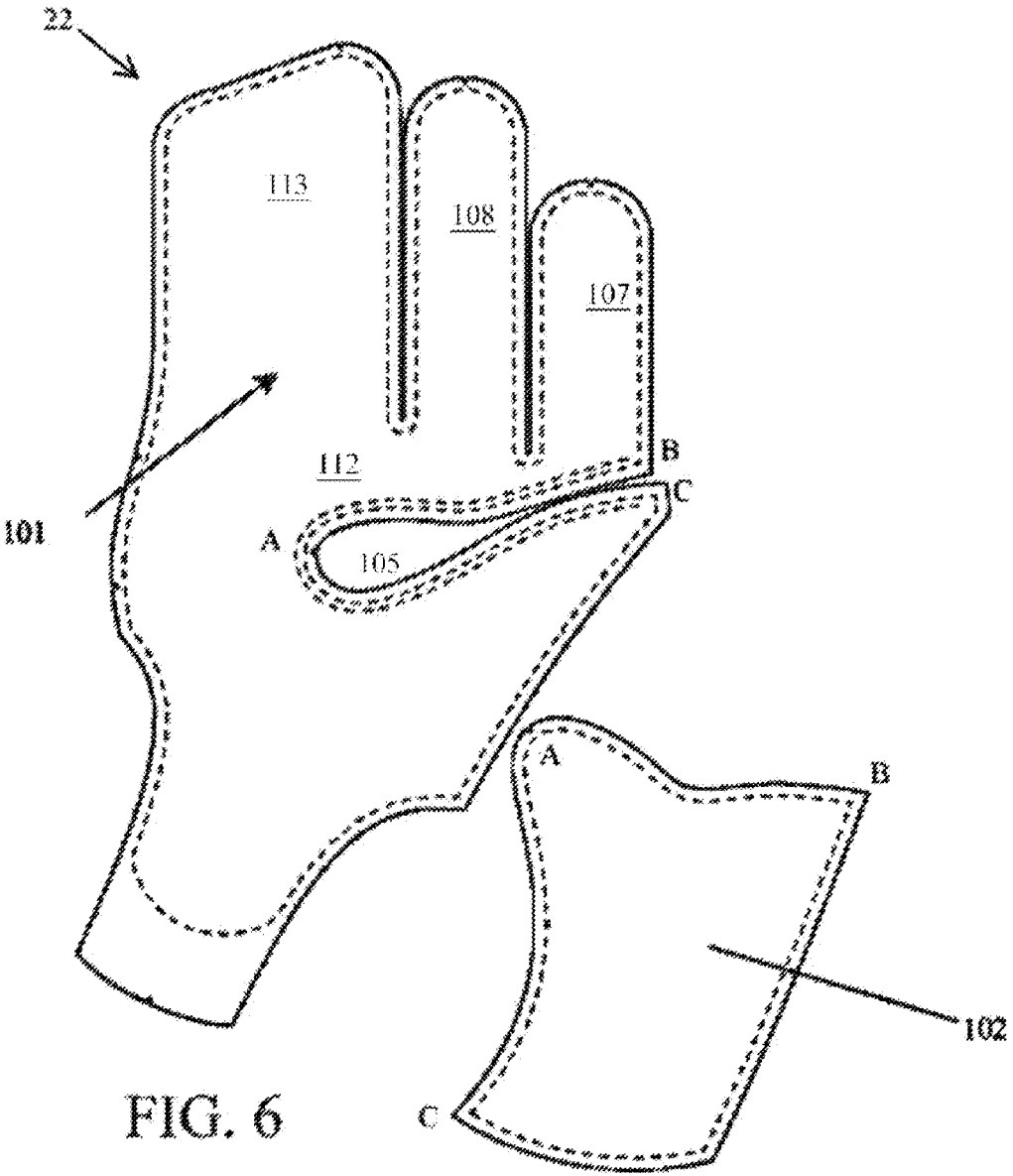
FIG. 6 is an exploded view of the fabric patterns making up the palmar side of the protective sports glove according to another embodiment of the present invention.

Additional embodiments of a palmar section 22 are possible, as shown in FIGS. 6 and 7, which show digit panel 101 having the shape designed to individually cover the wearer's thumb and ring and pinky fingers, and to cover with one continuous stretch of material the wearer's index and middle fingers. The upper section 101A of digit panel 101 may resemble a four-finger cutout, three-finger cutout, or two-finger cutout.

One skilled in the art will appreciate that the palmar section 2 of the glove may be attached along its edges to a dorsal section with dorsal padding to protect the wearer's hand when worn. One such dorsal portion is shown and described in applicant's co-pending U.S. patent application Ser. No. 14/080,097, filed 14 Nov. 2013, which is herein incorporated by reference in its entirety.

It should now be apparent that the above-described protective sports glove having a palmar section comprising any of the embodiments 2, 21 or 22 allows a user to flex the hand in all directions freely, to grip a lacrosse, hockey or other type of sports stick, and to maintain accurate tactile feel in the palmar side of the glove and at every necessary wrist inclination, all while maintaining a suitable level of protection. The palmar section 2, 21, 22 allows freer flexion and extension, as well as radial and ulnar deviation, and dorsiflexion.

The foregoing disclosure of embodiments of the embodiments of the present invention has been presented for purposes of illustration and description. It is not intended to be exhaustive or to limit the invention or its embodiments to the precise forms disclosed. Many variations and modifications of the embodiments described herein will be obvious to one of ordinary skill in the art in light of the above disclosure. The scope of the embodiments described here is to be defined only by the claims, and by their equivalents.

What is claimed is:

1. A method of making a palmar section for a protective sports glove comprising the steps of:

cutting a digit panel from a material blank in a cut pattern having a plurality of parallel-protruding finger sections protruding from a main section and a thumb section protruding from said main section and the thumb section protruding away from said finger sections at an obtuse angle, and a notch across said main section entering between two notch points along a periphery of said digit panel and traversing below said plurality of said finger sections to a third notch point;

cutting a palm panel from a material blank in a cut pattern having three contiguous corner points;

contorting said digit panel to rotate said thumb section toward said plurality of finger sections to reduce said obtuse angle to an acute angle and open said notch;

overlying said palm panel and said digit panel with the three corner points of said palm panel each aligned with a corresponding one of the three notch points, respectively; and sewing a seam through the three contiguous corner points of said palm panel and the three notch points of said digit panel and connecting said palm panel to said digit panel along said seam thereby leaving said palmar section seamless in an area configured to cover a crease between said a user's index finger and thumb.

2. The method of making the palmar section for the protective sports glove according to claim 1, wherein said step of cutting the digit panel from the material blank comprises cutting said digit panel with the plurality of finger sections wherein one finger section of the plurality of finger sections is configured to cover both an index finger and a middle finger of the user's hand.

3. The method of making the palmar section for the protective sports glove according to claim 1, wherein said step of cutting the digit panel from the material blank comprises cutting said digit panel wherein said main section is an unbroken crescent-shape joining all of said plurality of finger sections and said thumb section.

4. The method of making the palmar section for the protective sports glove according to claim 1, wherein said step of sewing said palm panel to said digit panel along said seam leaves said palmar section seamless in an area configured to be adjacent the proximal phalanges of the user's hand.

5. The method of making the palmar section for the protective sports glove according to claim 1, wherein said seam is a crescent-shaped seam joining the palm panel to said digit panel.

6. A method of making a palmar section for a protective sports glove comprising the steps of:

cutting a digit panel from a material blank in a cut pattern having a plurality of parallel-protruding finger sections protruding from a main section and a thumb section protruding from said main section and the thumb section protruding away from said finger sections at an obtuse angle, and a notch extending across said main section, entering between two notch points along a periphery of said digit panel and traversing beneath said plurality of said finger sections to a third notch point;

cutting a palm panel from a material blank in a four-sided cut pattern having four contiguous corner points;

sewing a seam connecting said palm panel to said digit panel by the substeps of, contorting said digit panel to rotate said thumb section toward said plurality of finger sections, open said notch, and reduce said obtuse angle to an acute angle, overlying said palm panel and said digit panel with three of said four contiguous corner points of said palm panel each aligned with one of said three notch points of said digit panel, respectively, and sewing the seam connecting each of the three contiguous corner points of said palm panel to one of said three notch points of said digit panel, respectively, thereby leaving said palmar section seamless in an unbroken area configured to cover a crease between a user's index finger and thumb.

7. The method of making the palmar section for the protective sports glove according to claim 6, wherein said step of cutting the digit panel from the material blank comprises cutting said digit panel with an oversized finger section configured to cover two fingers of the user's hand.

8. The method of making the palmar section for the protective sports glove according to claim 6, wherein said step of cutting the digit panel from the material blank comprises cutting said digit panel wherein said main section is an unbroken crescent-shape joining all of said plurality of finger sections and said thumb section.

9. The method of making the palmar section for the protective sports glove according to claim 6, wherein said step of sewing said palm panel to said digit panel along said seam leaves said palmar section seamless in an unbroken area configured to be adjacent the proximal phalanges of the user's hand.

10. The method of making the palmar section for the protective sports glove according to claim 6, wherein said seam is a crescent-shaped seam joining the palm panel to said digit panel.

* * * * *